US012385334B2

(12) United States Patent
Aleid

(10) Patent No.: US 12,385,334 B2
(45) Date of Patent: Aug. 12, 2025

(54) CONTROLLING LOST CIRCULATION WHILE DRILLING

(71) Applicant: Saudi Arabian Oil Company, Dhahran (SA)

(72) Inventor: Abdulrahman K. Aleid, Dhahran (SA)

(73) Assignee: Saudi Arabian Oil Company (SA)

( * ) Notice: Subject to any disclaimer, the term of this patent is extended or adjusted under 35 U.S.C. 154(b) by 0 days.

(21) Appl. No.: 18/588,337

(22) Filed: Feb. 27, 2024

(65) Prior Publication Data

US 2024/0247554 A1 Jul. 25, 2024

Related U.S. Application Data

(62) Division of application No. 17/458,032, filed on Aug. 26, 2021, now Pat. No. 12,012,810.

(51) Int. Cl.

| | |
|---|---|
| ***E21B 34/08*** | (2006.01) |
| ***E21B 21/00*** | (2006.01) |
| ***E21B 49/08*** | (2006.01) |

(52) U.S. Cl.

CPC ..... *E21B 21/003* (2013.01); *E21B 34/08* (2013.01); *E21B 49/0815* (2020.05); *E21B 49/0875* (2020.05); *E21B 49/088* (2013.01); *E21B 2200/04* (2020.05)

(58) Field of Classification Search

CPC ..... E21B 21/003; E21B 34/08
USPC ..... 175/72
See application file for complete search history.

(56) References Cited

U.S. PATENT DOCUMENTS

| | | | | |
|---|---|---|---|---|
| 8,025,102 | B2 | 9/2011 | Dewar | |
| 8,312,920 | B2 | 11/2012 | Tehrani et al. | |
| 9,109,992 | B2 | 8/2015 | Wang | |
| 10,513,902 | B2 | 12/2019 | Funkhouser et al. | |
| 2009/0188718 | A1* | 7/2009 | Kaageson-Loe | E21B 21/003 175/57 |
| 2018/0216430 | A1* | 8/2018 | Stewart | E21B 23/02 |
| 2019/0257973 | A1* | 8/2019 | AlBahrani | E21B 29/10 |
| 2021/0172281 | A1* | 6/2021 | Li | E21B 21/003 |

* cited by examiner

*Primary Examiner* — William D Hutton, Jr.
*Assistant Examiner* — Ashish K Varma
(74) *Attorney, Agent, or Firm* — Fish & Richardson P.C.

(57) ABSTRACT

Techniques for controlling lost circulation while drilling include while drilling a wellbore, encountering a high-loss circulation zone by a bottomhole assembly; responsive to encountering the high-loss circulation zone, releasing a first lost circulation media retained within the bottomhole assembly; and receiving a second lost circulation media, by the bottomhole assembly, from circulation fluid circulated from a topside facility.

20 Claims, 8 Drawing Sheets

CONTROLLING LOST CIRCULATION WHILE DRILLING

CROSS-REFERENCE TO RELATED APPLICATION

This application is a divisional of and claims priority to U.S. patent application Ser. No. 17/458,032, filed on Aug. 26, 2021, the entire contents of which are incorporated by reference herein.

TECHNICAL FIELD

This disclosure relates to mitigating high-loss zones during wellbore drilling.

BACKGROUND

To form a wellbore into a geologic formation, a drill bit pulverizes a path through the geological formation. During the drilling process, drilling fluid is circulated to cool and lubricate the bit, remove the pulverized bits of the formation (also known as "cuttings"), and maintain a static pressure on the reservoir formation. In some instances, during the drilling process, a high-loss zone can be encountered. A high-loss zone is a zone in which drilling circulation fluid is lost from the wellbore to the geologic formation. Circulation fluid can be expensive and is normally recirculated through the wellbore continuously. When circulation is lost to the geologic formation in the high-loss zone, more circulation fluid is often added at great expense. In addition, the loss of fluid reduces the static pressure on the geologic formation. Such a loss in pressure can result in a "kick", or a pressurized release of hydrocarbons from the wellbore. When a high-loss formation is encountered, loss control materials can be added to the drilling circulation fluid to plug the high-loss zone. The loss control material is able to plug the high-loss zone by becoming lodged within the pores and fractures located in the walls of the wellbore.

SUMMARY

This disclosure describes technologies relating to controlling lost circulation while drilling.

An example implementation of the subject matter within this disclosure is a bottomhole assembly with the following features. A tubular defines a central flow passage. A camera has an aperture and attached to an outer surface of the tubular with the aperture oriented away from the outer surface of the tubular. A lost circulation media reservoir is circumferentially surrounding at least a portion of the outer surface of the tubular. The lost circulation media reservoir is adjacent to the camera. The lost circulation media reservoir includes actuable gates along a periphery of the lost circulation media reservoir. A trigger is communicably coupled with the actuable gates and configured to actuate the actuable gates.

Aspects of the example bottomhole assembly, which can be combined with the bottomhole assembly alone or in combination with other aspects, can include the following. A drill bit is downhole of the lost circulation media reservoir and the camera.

Aspects of the example bottomhole assembly, which can be combined with the example bottomhole assembly alone or in combination with other aspects, can include the following. The trigger includes a movable ball seat and a linkage connecting the movable ball seat to the actuable gates.

Aspects of the example bottomhole assembly, which can be combined with the example bottomhole assembly alone or in combination with other aspects, can include the following. The lost circulation media includes particles larger than nozzles defined by a drill bit included with the bottomhole assembly.

Aspects of the example bottomhole assembly, which can be combined with the example bottomhole assembly alone or in combination with other aspects, can include the following. The lost circulation media reservoir is a first lost circulation media reservoir. The trigger is a first trigger. The bottomhole assembly further includes a second lost circulation media reservoir identical to the first lost circulation media reservoir. A second trigger is configured to actuate actuable gates of the second lost circulation media reservoir responsive to a second stimulus from a topside facility.

Aspects of the example bottomhole assembly, which can be combined with the example bottomhole assembly alone or in combination with other aspects, can include the following. The bottomhole assembly includes a sealing material reservoir.

Aspects of the example bottomhole assembly, which can be combined with the example bottomhole assembly alone or in combination with other aspects, can include the following. The sealing material is a resin.

An example of the subject matter described within this disclosure is a method with the following features. While drilling a wellbore, a high-loss circulation zone is encountered by a bottomhole assembly. A first lost circulation media retained within the bottomhole assembly is released responsive to encountering the high-loss circulation zone. a second lost circulation media is received by the bottomhole assembly from circulation fluid circulated from a topside facility.

Aspects of the example method, which can be combined with the example method alone or in combination with other aspects, can include the following. A sealant is released by the bottomhole assembly.

Aspects of the example method, which can be combined with the example method alone or in combination with other aspects, can include the following. The first lost circulation media includes larger particles than the second lost circulation media.

Aspects of the example method, which can be combined with the example method alone or in combination with other aspects, can include the following. Releasing the first lost circulation media includes receiving a ball by a ball seat trigger within the bottomhole assembly. The ball seat trigger is moved by a differential pressure across the seated ball. A gate retaining the lost circulation media is opened by the moving ball seat trigger.

Aspects of the example method, which can be combined with the example method alone or in combination with other aspects, can include the following. A first picture of the high-loss circulation zone is captured by the bottomhole assembly. A second picture is captured by the bottomhole assembly after the second lost circulation has been received.

Aspects of the example method, which can be combined with the example method alone or in combination with other aspects, can include the following. A sealant is released by the by the bottomhole assembly prior to capturing the second picture.

Aspects of the example method, which can be combined with the example method alone or in combination with other aspects, can include the following. The high-loss circulation zone is a first high-loss circulation zone. A second high-loss circulation zone is encountered by the bottomhole assembly a third picture of the second high-loss circulation zone is captured by the bottomhole assembly. Responsive to encountering the second high-loss circulation zone, a third lost circulation media retained within the bottomhole assembly is released. A fourth lost circulation media is received by the bottomhole assembly from circulation fluid circulated from a topside facility.

Aspects of the example method, which can be combined with the example method alone or in combination with other aspects, can include the following. A particle size of the third lost circulation media is substantially similar to the particle size of the first lost circulation media.

Aspects of the example method, which can be combined with the example method alone or in combination with other aspects, can include the following. A particle size of the fourth lost circulation media is substantially similar to the particle size of the second lost circulation media.

An example of the subject matter described within this disclosure is a workstring with the following features. A camera is oriented to face a wall of a wellbore. The camera is configured to capture pictures of the wall of the wellbore before and after sealing operations. A lost circulation media reservoir includes an actuable gate along a periphery of the lost circulation media reservoir. The actuable gate is configured to retain or release lost circulation media based upon a position of the actuable gate. A liquid sealant reservoir is also included on the work string. A trigger is configured to actuate the actuable gates responsive to a stimulus from a topside facility. A drill bit at a downhole end of the workstring.

Aspects of the example workstring, which can be combined with the example workstring alone or in combination with other aspects, can include the following. The lost circulation media includes particles larger than nozzles defined by the drill bit.

Aspects of the example workstring, which can be combined with the example workstring alone or in combination with other aspects, can include the following. The liquid sealant includes a resin.

Aspects of the example workstring, which can be combined with the example workstring alone or in combination with other aspects, can include the following. The trigger includes a movable ball seat configured to axially translate in a downhole direction within the workstring responsive to receiving a ball circulated from a topside facility. a linkage couples the movable ball seat to the actuable gate such that the actuable gate transitions from a closed position to an open position responsive to the movable ball seat axially translating in the downhole direction.

Particular implementations of the subject matter described in this disclosure can be implemented so as to realize one or more of the following advantages. The subject matter described herein allows for increased sealing capabilities compared to traditional methods. Alternatively or in addition, the subject matter described herein allows for plugging high-loss zones while drilling without the need to pull the drill string from the wellbore during drilling operations.

The details of one or more implementations of the subject matter described in this disclosure are set forth in the accompanying drawings and description. Other features, aspects, and advantages of the subject matter will become apparent from the description, the drawings, and the claims.

DETAILED DESCRIPTION

When encountering a high-loss zone, a large volume of drilling fluid can be lost into the geologic formation accompanied by a quick drop of the fluid column within the wellbore. The drop of fluid column can trigger various drilling problems such as stuck pipe, wellbore instability, a kick, or a blowout, all of which can lead to side tracking or abandonment of a well. The possibility of causing various drilling problems increases with increasing delay in controlling the loss of circulation fluid. Lost circulation media can be used to mitigate losses of drilling fluid when a high-loss zone is encountered during drilling operations. Lost circulation media can include particulates or hydratable fluids to block off the high-loss zone. Particulates block the high-loss zone by becoming trapped within rock-pores and fractures along the wellbore wall through which the drilling fluid passes into the geologic formation. Effective control of the loss of whole fluid requires the deposition of a resilient, stable, and tight seal that can maintain integrity and stability during changing in-situ stress conditions, depleted reservoir conditions, varying tectonic conditions, fluctuating operating conditions under high surge and swabbing pressures, and many other downhole conditions, in order to provide short, as well as long term, control of whole fluid losses. Significant amounts of resilient lost circulation media can often be needed to isolate a high-loss zone. High-loss zones can include a variety of fracture and pore sizes that can make selecting a single lost circulation media particle size difficult, especially as the drill bit nozzles limit the size of lost circulation material that can be used.

This disclosure relates to a bottomhole assembly, for use in drilling, which includes a reservoir of large-sized lost circulation media particles that can be deployed when a high-loss zone is encountered. When a high-loss zone is encountered, the drillstring drills past the high-loss zone while a camera on the bottomhole assembly records pictures of the high-loss zone. The reservoir is then triggered, for example, by a dropped ball, to release the large-sized lost circulation media to perform an initial sealing of the high-loss zone. Shortly afterwards, small-sized lost circulation media is circulated into the wellbore to supplement the large-sized lost circulation media to ensure the high-loss zone is adequately sealed. An additional sealant can be sprayed onto the high-loss zone to further ensure adequate sealing. Pictures of the high-loss zone are captured before and after mitigation operations. Drilling can then continue without ever having removed the drillstring from the wellbore.

Figure 1:
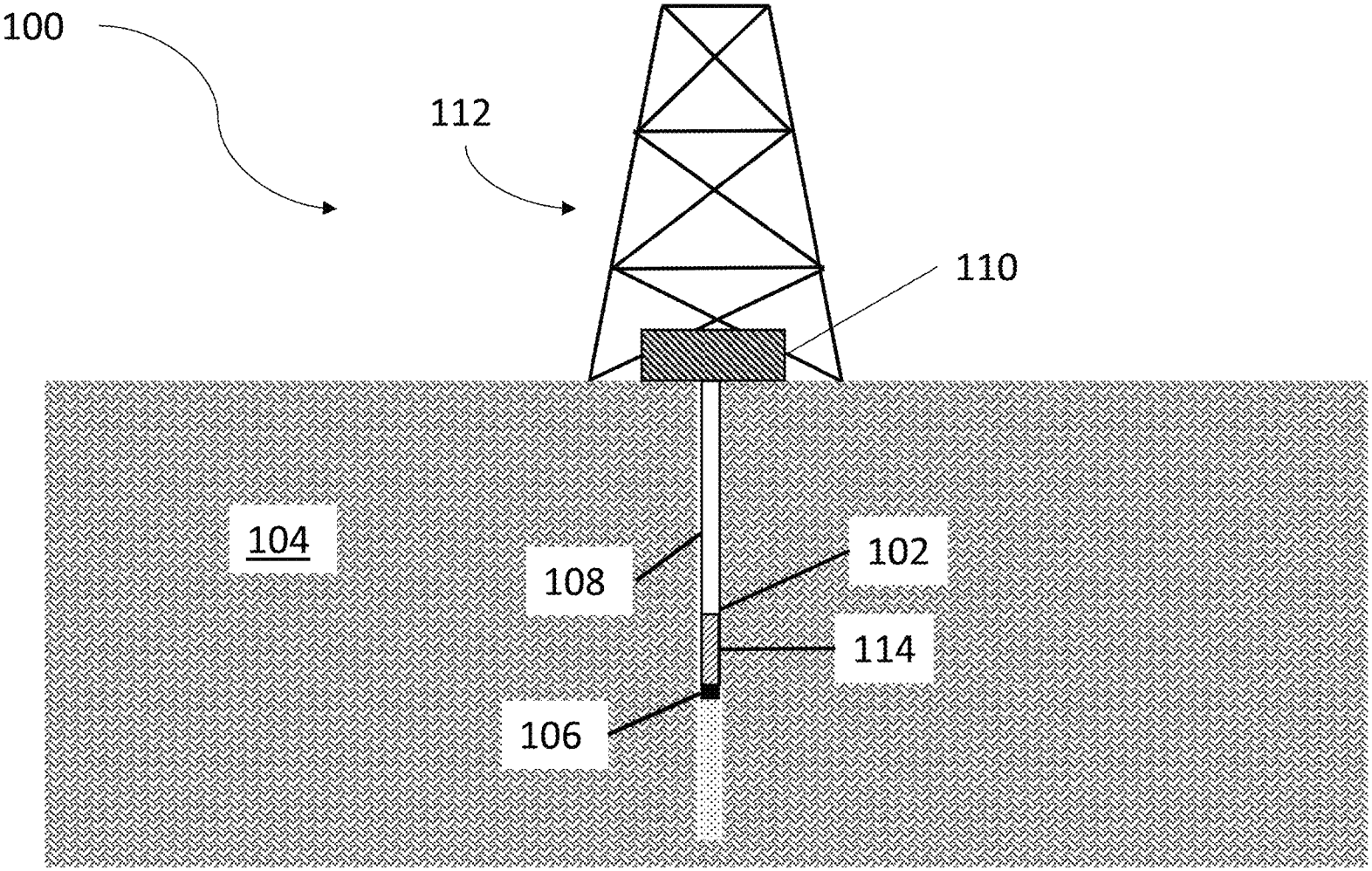
FIG. 1 is a side cross-sectional view of an example wellsite.

FIG. 1 is a side cross-sectional view of an example wellsite 100. A wellbore 102 is in the process of being formed within a geologic formation 104 by a drill bit 106 at a downhole end of a drillstring (workstring) 108. At an uphole end of the wellbore 102 is a topside facility 110. The topside facility 110 can include a derrick 112 to support the workstring 108. The topside facility 110 also includes pumps, shaker tables, separators, and any other equipment common to wellbore drilling facilities. At a downhole end of the workstring 108 is a bottomhole assembly (BHA) 114. In some implementations, the drill bit 106 and the BHA 114 can be integrated into a single unit. In some implementations, the drill bit 106 is a separate, distinct component apart from the BHA 114. While primarily illustrated as being used with a vertical wellbore, the subject matter described herein can be similarly applied to horizontal or deviated wellbores.

Figure 2:
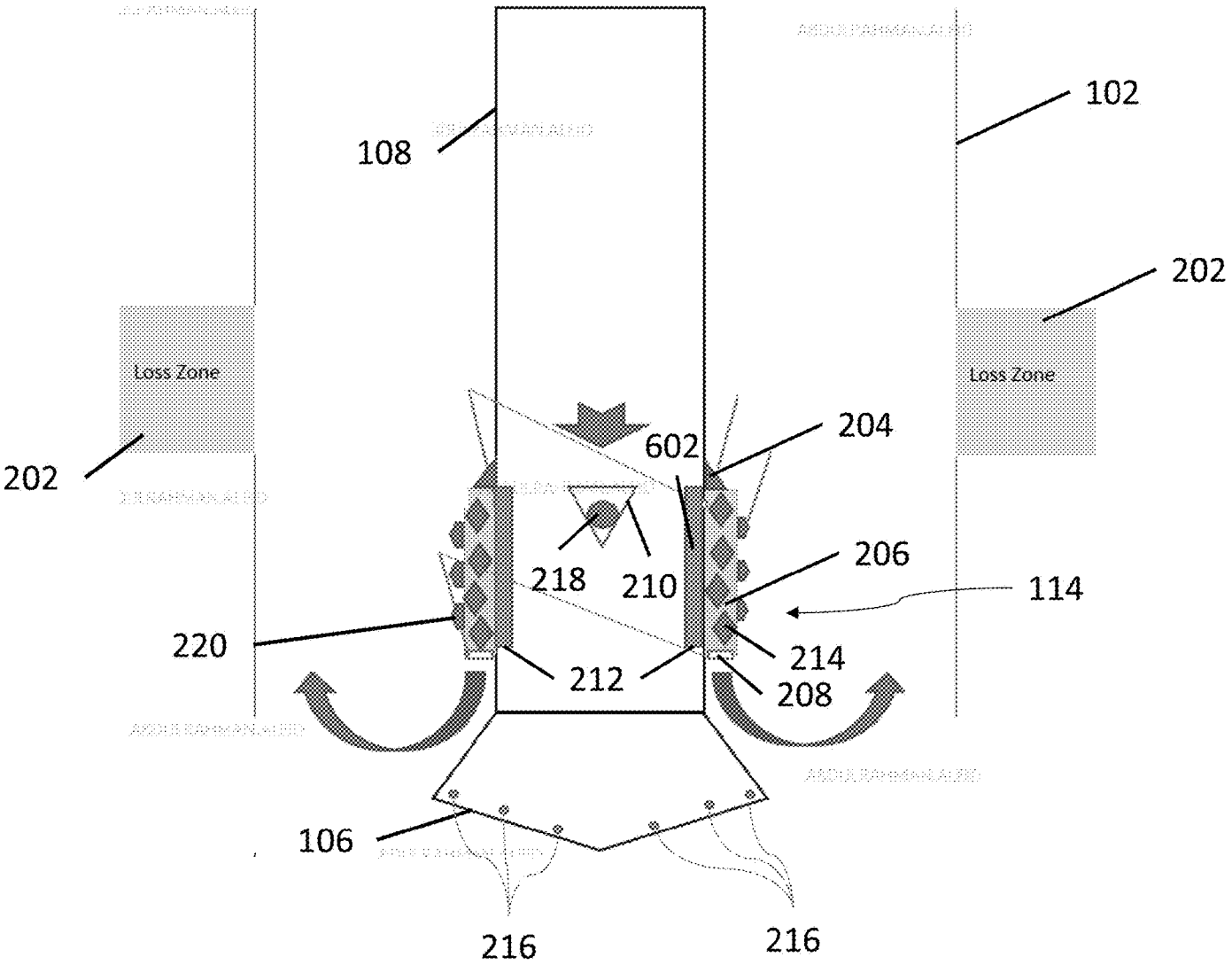
FIG. 2 is a side view of a bottomhole assembly adjacent to a high-loss zone within the wellbore.

FIG. 2 is a side view of a BHA 114 adjacent to a high-loss zone 202 within the wellbore 102. The BHA 114 includes a tubular, for example, the workstring 108, which defines a central flow passage. The central flow passage carries circulation fluid from the topside facility 110 (FIG. 1) and through the drill bit 106. The circulation fluid, lubricates and cools the drill bit 106 during drilling operations. The circulation fluid also carries cuttings, formed by the drill bit 106, up the annulus defined by the wall of the wellbore and an outer surface of the workstring 108. The circulation fluid also acts as a buffer against fluids within the geologic formation 104 as the circulation fluid provides a static pressure against any fluids within the geologic formation 104. In some instances, a high-loss zone 202 is encountered. A high-loss zone 202 is an area of the geologic formation that is at a lower pressure than the circulation fluid. As such, circulation fluid is lost into the geologic formation, reducing the static head available to control the wellbore, and creating a need to further replenish circulation fluids at the topside facility.

The BHA 114 also includes a camera 204 attached or affixed to an outer surface of the tubular 108 and oriented to face a wall of a wellbore 102. That is, the camera 204 includes an aperture oriented away from the outer surface of the tubular 108. The camera 204 can be used to take or capture pictures of the wall of the wellbore, for example, pictures captured before and after a wellbore operation. In some implementations, the camera 204 is communicatively coupled to the topside facility 110, for example, through electrical cables, optical cables, or radio communication. In some implementations, the camera can be operated by an operator remotely, for example, from the topside facility 110. In some implementations, the camera 204 can be operated autonomously, for example, by a downhole controller (not shown).

The BHA 114 also includes a lost circulation media reservoir 206 (at least partially) circumferentially surrounding at outer surface of the tubular (workstring) 108. In some implementations, the lost circulation media reservoir 206 can be adjacent to the camera 204. The lost circulation media reservoir 206 includes actuable gates 208 along a periphery of the lost circulation media reservoir 206. The actuable gates 208 are coupled to a trigger 210 configured to actuate the actuable gates 208 responsive to a stimulus from a topside facility. For example, the trigger 210 can include a movable ball seat configured to axially translate in a downhole direction within the workstring 108 responsive to receiving a ball 218 circulated from a topside facility 110. The ball can include a dissolvable ball that dissolves after a set duration of time, or the ball can be a standard ball. In instances where a standard ball is used, the standard ball can be removed (that is, unseated) by reverse circulations. In implementations that a ball is used, a linkage couples the movable ball seat to the actuable gates 208 such that the actuable gate 208 transitions from a closed position to an open position responsive to the movable ball seat axially translating in the downhole direction. In some implementations, the linkage can include levers, cables, pulleys, or a combination of such components. Once operations are completed, the ball can be returned by reversing circulation within the BHA 114. Alternatively, the ball 218 can receive an "over pressure" that causes shear pins on the ball seat trigger 210 to shear. The ball 218 and ball seat trigger 210 are then received by a catch basket within the BHA 114, allowing circulation fluid to flow around the ball 218. Alternatively or in addition, radio frequency identification tags or mud pulse signals can be used to trigger operations.

In some implementations, the BHA 114 can also include a liquid sealant reservoir 212. The liquid sealant 602 is applied by sealant nozzles 220 arranged along a periphery of the BHA 114. In some implementations, the liquid sealant 602 includes a resin. Other sealants with similar characteristics to resin, for example, the ability to cure in a downhole environment, can be used without departing from this disclosure.

Generally, the first lost circulation media 214 within the lost circulation media reservoir 206 includes particles larger than nozzles 216 defined by the drill bit 106 included with the BHA 114. Reasons for the size discrepancy are described throughout this disclosure.

Figure 3:
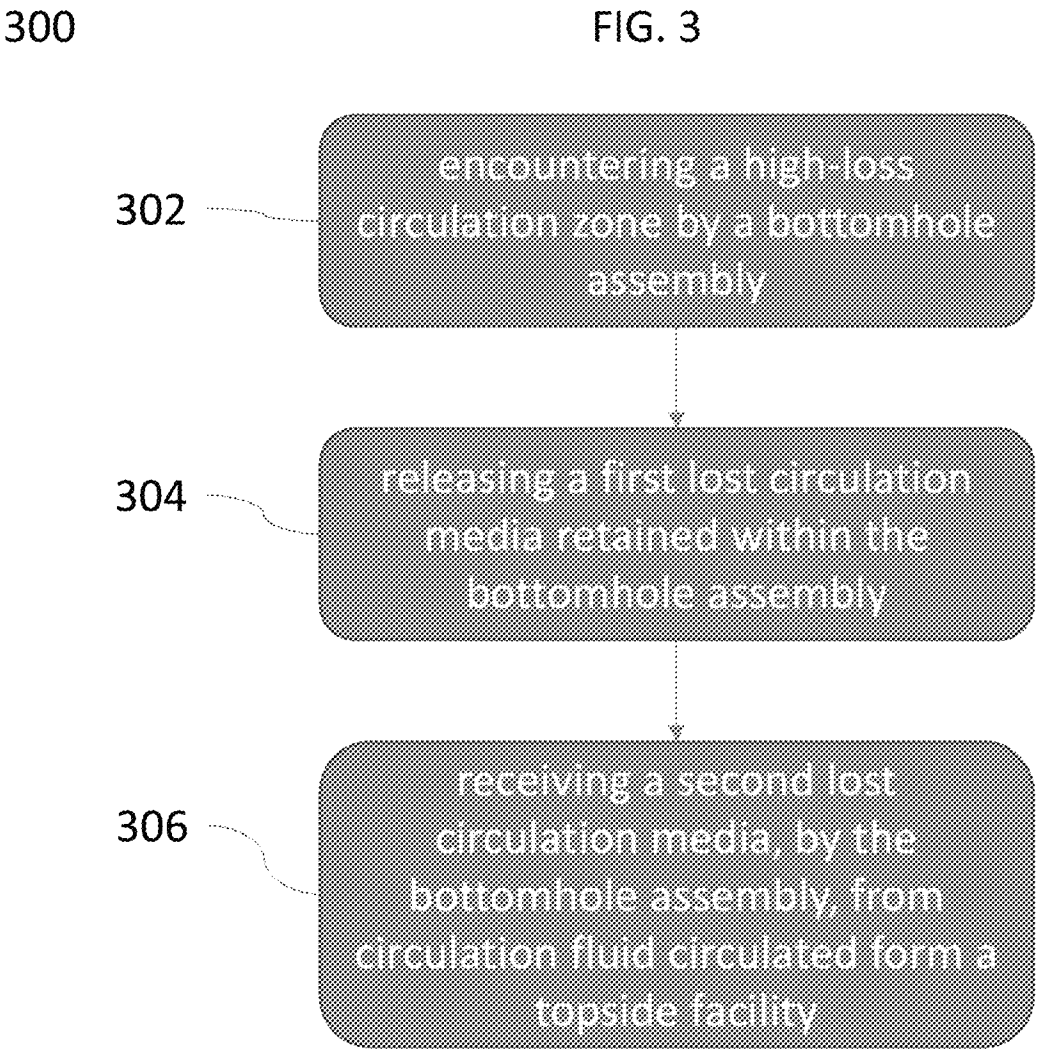
FIG. 3 is a flowchart of a method that can be used with aspects of this disclosure.
Figure 4:
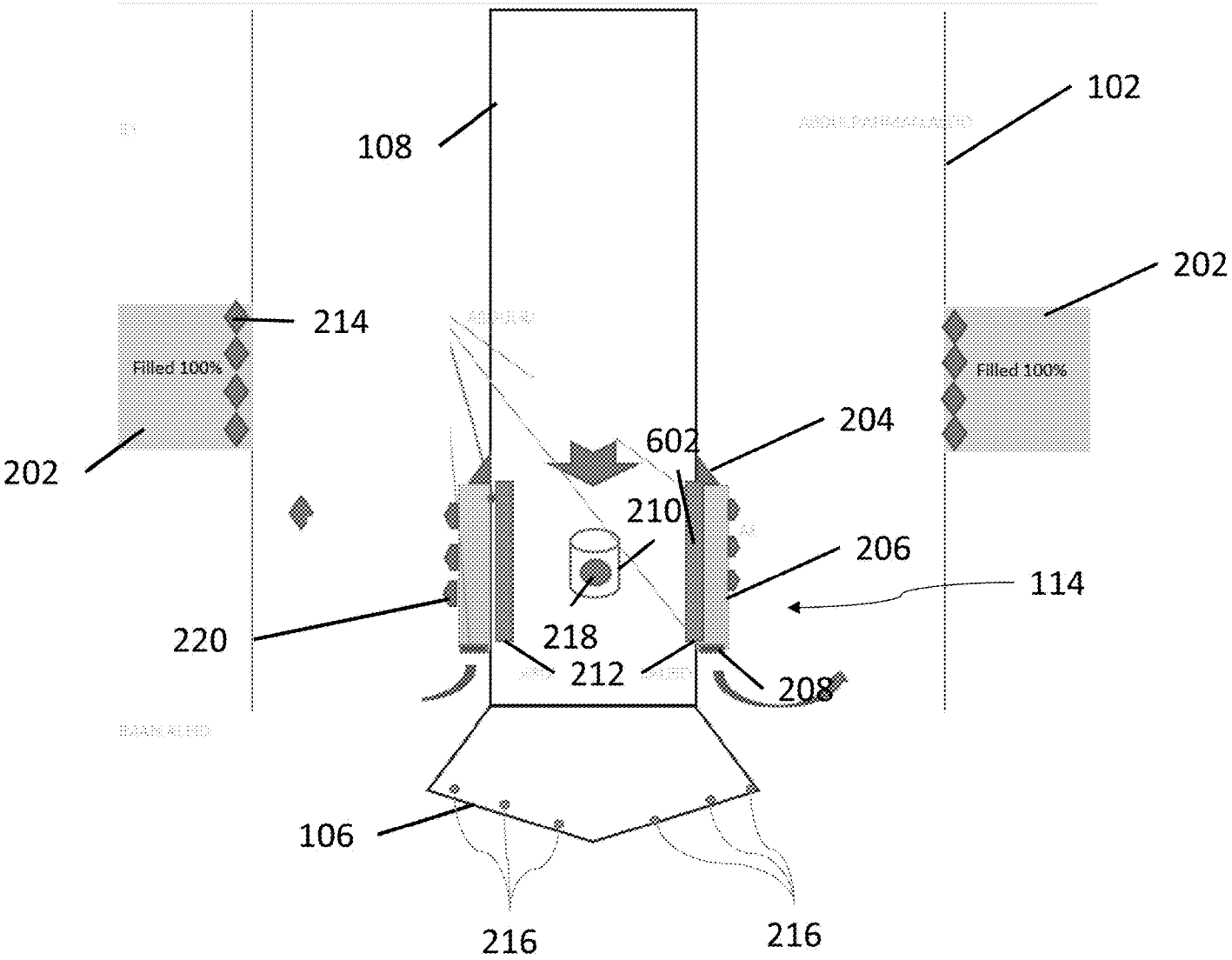
FIG. 4 is a side view of the bottomhole assembly adjacent to a high-loss zone during operation.

FIG. 3 is a flowchart of a method 300 that can be used with aspects of this disclosure. At 302, while drilling a wellbore, a high-loss circulation zone 202 is encountered by the BHA 114, such as is shown in FIG. 4. FIG. 4 is a side view of the BHA 114 adjacent to the high-loss zone 202 during operation. At 304, responsive to encountering the high-loss circulation zone 202, a first lost circulation media 214 retained within the BHA 114 is released. In some implementations, the first lost circulation media 214 includes larger particles than a second lost circulation media (described later).

In some implementations, releasing the first lost circulation media 214 includes receiving a ball 218 by a ball seat trigger 210 within the BHA 114. Such a ball 218 can be circulated from the topside facility and can be a standard ball or a dissolving ball. Regardless of the ball used, the ball seat trigger is moved by a differential pressure across the seated ball 218. The gate 208 retaining the first lost circulation media 214 is opened by the moving ball seat trigger 210. That is, a linkage (not shown) couples the movement of the ball seat trigger 210 to the movement of the gate 208.

In some instances, prior to releasing the first lost circulation media 214, a picture of the high-loss zone 202 is captured by the camera 204 on the BHA 114.

Figure 5:
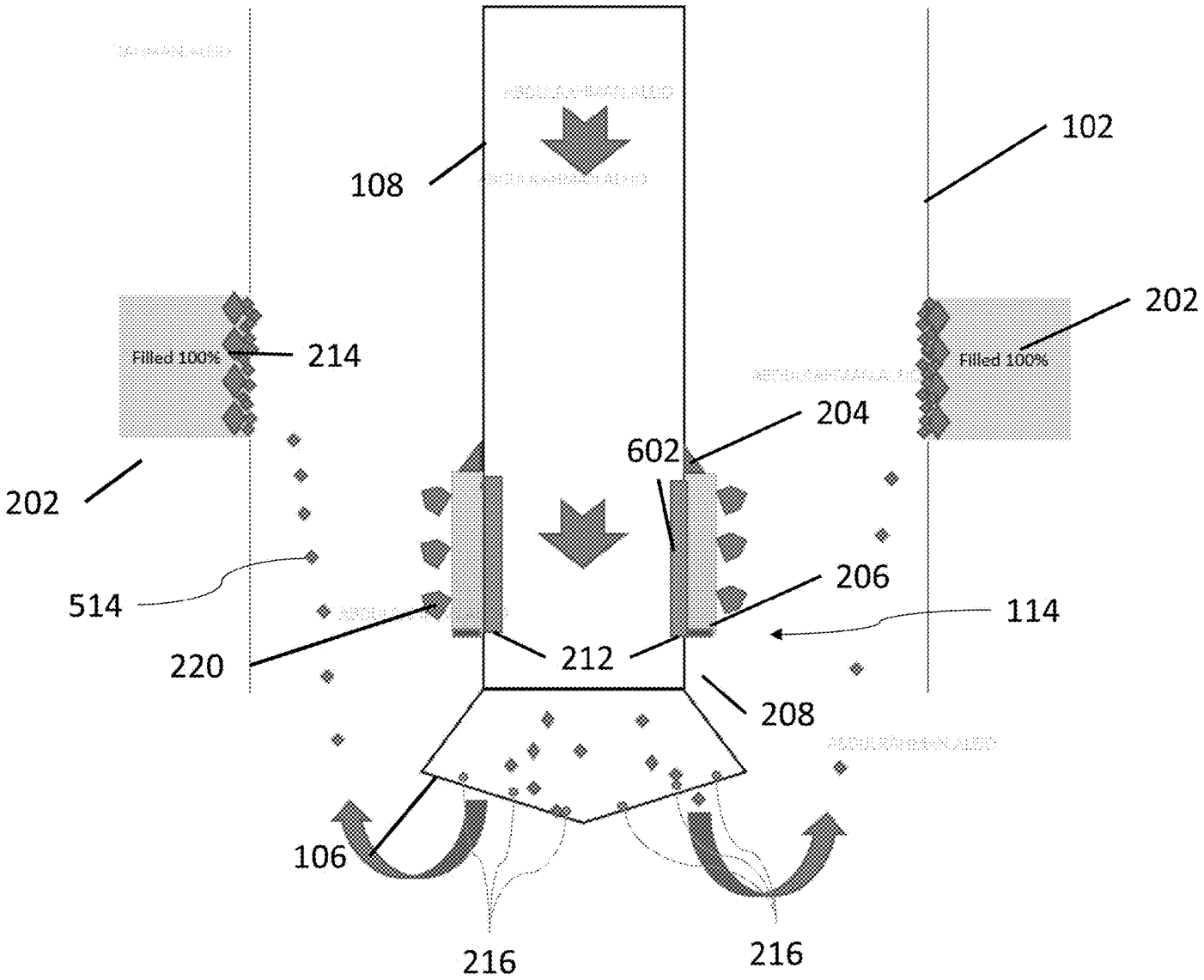
FIG. 5 is a side view of the bottomhole assembly adjacent to a high-loss zone during operation.

FIG. 5 is a side view of the BHA 114 adjacent to the high-loss zone 202 during operations subsequent to those illustrated in FIG. 4. Referring back to FIG. 3, at 306, a second lost circulation media 514 is received by the bottomhole assembly from circulation fluid circulated from a topside facility. As the second lost circulation media 514 is delivered by circulation fluid, the size of the second circulation media is smaller than the circulation ports defined by the drill bit 106. As such, particles of the second lost circulation media are often smaller than those found in the first circulation media.

The first lost circulation media 214 plugs the larger gaps of the high-loss circulation zone, while the (typically smaller) particles within the second lost circulation media 514 fill in the finer gaps. While primarily described and illustrated as using a first, coarse lost circulation media 214, followed by a second, finer lost circulation media 514, in some implementations, particles in the first lost circulation media 214 and in the second lost circulation media 514 are substantially the same size (within standard manufacturing tolerances).

Figure 6:
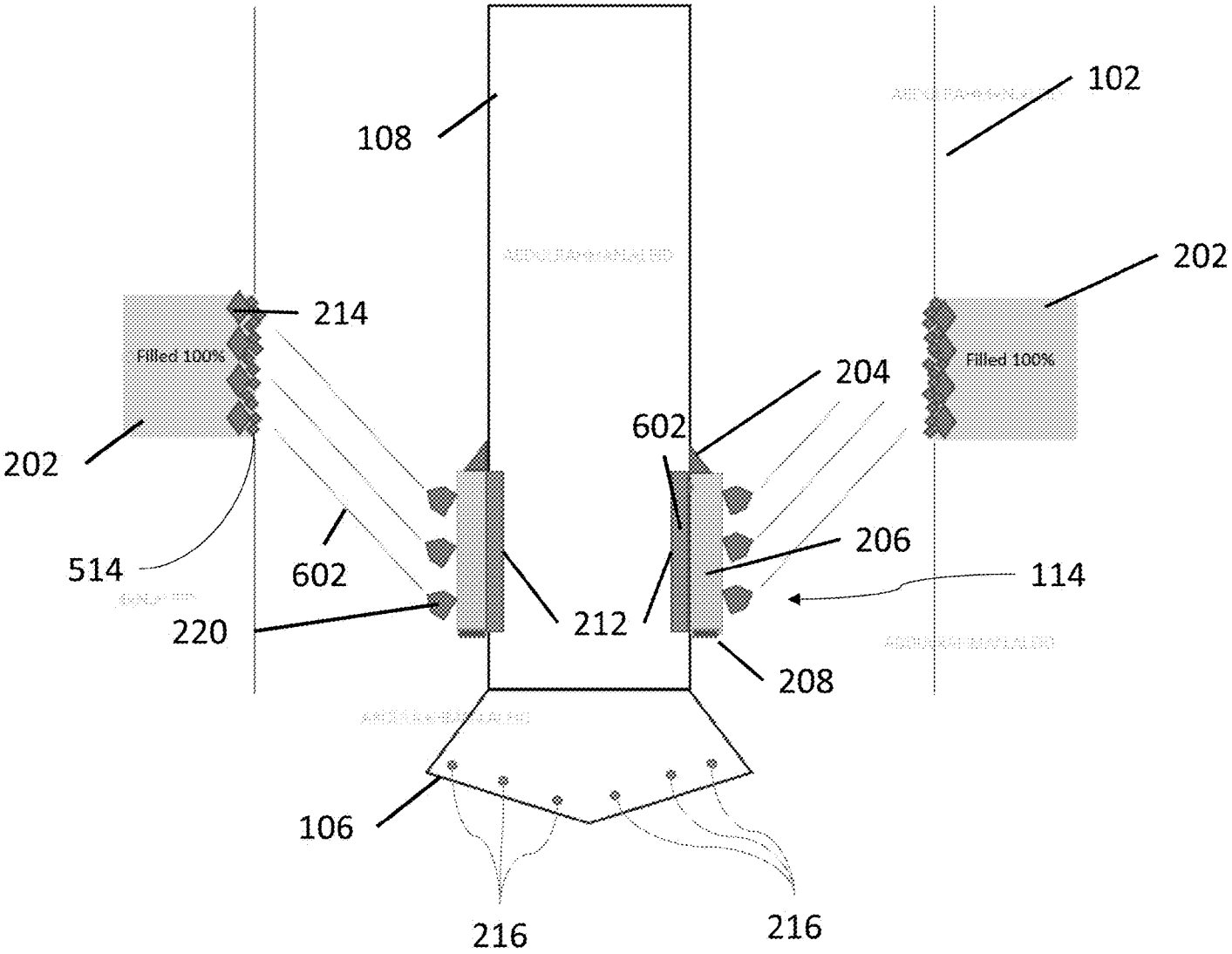
FIG. 6 is a side view of the bottomhole assembly adjacent to a high-loss zone during operation.

FIG. 6 is a side view of the BHA 114 adjacent to the high-loss zone 202 during operations subsequent to those illustrated in FIG. 5. After the first lost circulation media 214 and the second lost circulation media 514 are dispensed, the BHA 114 releases a sealant 602 into the wellbore 102 from a sealing material reservoir 212. In some implementations, the sealant can be applied by sealant nozzles 220. A variety of sealants can be used, for example, a resin. The spray system can be triggered a variety of ways, for example, by another dropped ball, by a controller receiving a signal from the topside facility 110. Such a signal can trigger a pressurized reservoir that pushes the sealing material out of the nozzles 220 and can be deactivated once the sealant is released. In some implementation, the sealant 602 can be configured to be released automatically after the first lost circulation media 214 and second lost circulation media 514 is released.

Figure 7:
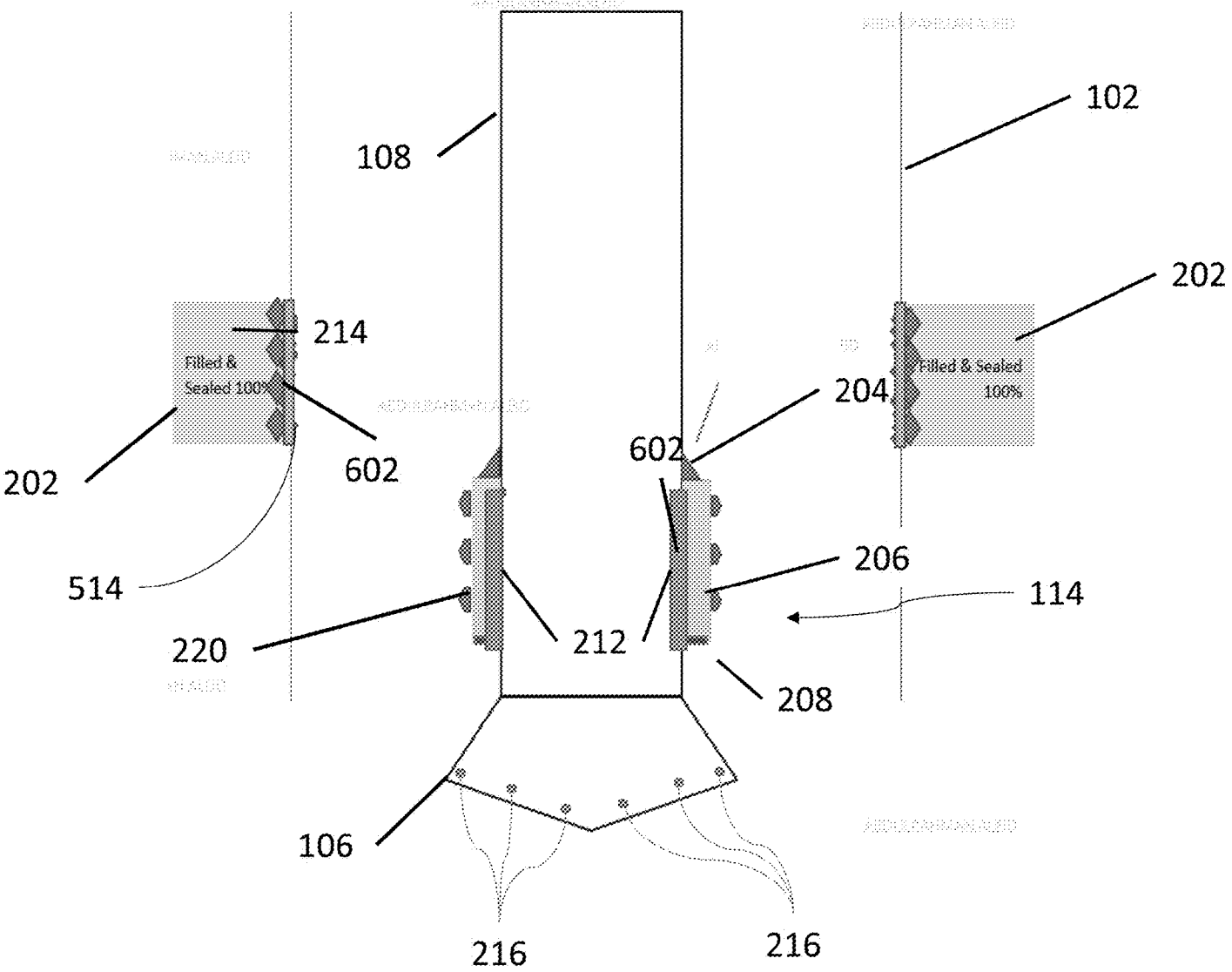
FIG. 7 is a side view of the bottomhole assembly adjacent to a high-loss zone during operation.

FIG. 7 is a side view of the bottomhole assembly adjacent to a high-loss zone during operations subsequent to those illustrated in FIG. 6. After the sealant is released, a second picture is captured by the camera of the high-loss zone. The second picture can provide a comparison with the picture captured prior to mitigation operations and can be used as a check for the effectiveness of the mitigation efforts.

Figure 8:
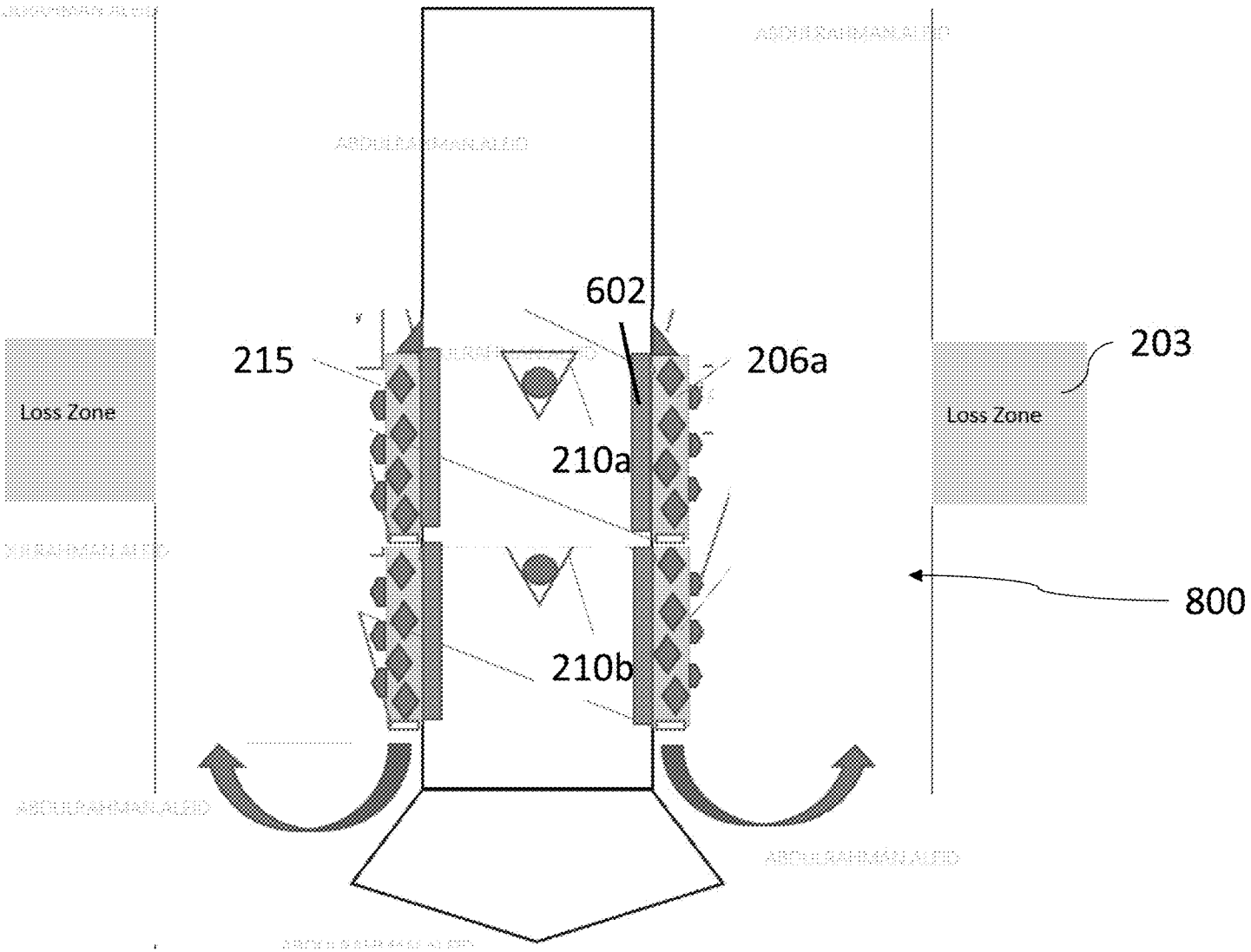
FIG. 8 is a side view of a bottomhole assembly adjacent to a high-loss zone within the wellbore.

FIG. 8 is a side view of a bottomhole assembly (BHA) 800 adjacent to a high-loss zone 202 within the wellbore. The BHA 800 is substantially similar to the BHA 114 previously described with the exception of any differences described herein. The BHA 800 includes a first lost circulation reservoir 206*a* and a second lost circulation reservoir 206*b*. Such an arrangement allows for multiple high-loss zones to be sealed within a single wellbore trip. Both the first lost circulation reservoir 206*a* and the second lost circulation reservoir 206*b* are coupled to a first ball seat trigger 210*a* and a second ball seat trigger 210*b* respectively. In some implementations, the ball seat triggers (210*a*, 210*b*) can have different diameters to allow them to be triggered individually by different diameter balls.

Such an arrangement allows the BHA 800 to mitigate a first high-loss zone 202 as previously described, as well as a second high-loss circulation zone 203 when one is encountered. In such instances, similar to the prior encounter, a picture of the second high-loss zone is captured by the BHA 114. Responsive to encountering the second high-loss circulation zone 202, a third lost circulation media 215 retained within the bottomhole assembly is released. In some implementations, a particle size of the third lost circulation media 215 is substantially similar to the particle size of the first lost circulation media 214. After the third lost circulation media 215 is released, a fourth lost circulation media is received by the BHA 114 from circulation fluid circulated from a topside facility (not shown). In some implementations, a particle size of the fourth lost circulation media is substantially similar to the particle size of the second lost circulation media 514. In some implementations, after the fourth lost circulation media is circulated, a second sealant is released onto the high-loss circulation zone. In some implementations, the second sealant can include a similar composition to the first sealant; however, different sealant compositions can be used without departing from this disclosure.

While this disclosure contains many specific implementation details, these should not be construed as limitations on the scope of any inventions or of what may be claimed, but rather as descriptions of features specific to particular implementations. Certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may have been previously described as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. For example, in some implementations, the second lost circulation media 514 can be circulated prior to the release of the first lost circulation media 214 without departing from this disclosure. Moreover, the separation of various system components in the implementations described previously should not be understood as requiring such separation in all implementations, and it should be understood that the described program components and systems can generally be integrated together in a single product or packaged into multiple products.

Thus, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results.

What is claimed is:

1. A method, comprising:

while drilling a wellbore, encountering a high-loss circulation zone by a bottomhole assembly that comprises one or more actuable gates and a trigger;

responsive to encountering the high-loss circulation zone and to actuation of the actuable gates by the trigger, releasing a first lost circulation media retained within the bottomhole assembly;

capturing, with a camera of the bottomhole assembly, a first image of a portion of the high-loss circulation zone prior to release of the first lost circulation media from the bottomhole assembly in response to actuation of the one or more actuable gates by the trigger;

capturing with the camera, a second image of a portion of the high-loss circulation zone subsequent to release of the first lost circulation media from the bottomhole assembly in response to actuation of the one or more actuable gates by the trigger; and receiving a second lost circulation media, by the bottomhole assembly, from circulation fluid circulated from a topside facility.

2. The method of claim 1, further comprising releasing a sealant by the bottomhole assembly.

3. The method of claim 2, further comprising:

subsequent to releasing the sealant, capturing, with the camera, a third image after the second lost circulation has been received by the bottomhole assembly.

4. The method of claim 2, wherein releasing the sealant by the bottomhole assembly comprises:

receiving a release signal subsequent to release of the first lost circulation media; and based on the release signal, releasing the sealant from a sealing material reservoir through one or more sealing material nozzles.

5. The method of claim 4, wherein the release signal is received in response to activation of the trigger to release the first lost circulation media retained within the bottomhole assembly.

6. The method of claim 2, wherein the high-loss circulation zone is a first high-loss circulation zone, the method further comprising:

encountering a second high-loss circulation zone by the bottomhole assembly;

capturing, with the camera, a fourth image of the second high-loss circulation zone;

responsive to encountering the second high-loss circulation zone, releasing a third lost circulation media retained within the bottomhole assembly; and receiving a fourth lost circulation media, by the bottomhole assembly, from circulation fluid circulated from a topside facility.

7. The method of claim 6, wherein a particle size of the third lost circulation media is substantially similar to the particle size of the first lost circulation media.

8. The method of claim 6, wherein a particle size of the fourth lost circulation media is substantially similar to the particle size of the second lost circulation media.

9. The method of claim 2, wherein the sealant comprises resin.

10. The method of claim 1, wherein the first lost circulation media comprises larger particles than the second lost circulation media.

11. The method of claim 1, wherein the trigger comprises a ball seat trigger, and releasing the first lost circulation media comprises:

receiving a ball by the ball seat trigger within the bottomhole assembly;

moving the ball seat trigger by a differential pressure across the seated ball; and opening the one or more actuable gates retaining the lost circulation media by the moving ball seat trigger.

12. The method of claim 1, further comprising:

capturing, with the camera, a third image after the second lost circulation has been received, by the bottomhole assembly.

13. The method of claim 12, further comprising:

releasing a sealant by the by the bottomhole assembly prior to capturing the third image.

14. The method of claim 1, wherein the high-loss circulation zone is a first high-loss circulation zone, the method further comprising:

encountering a second high-loss circulation zone by the bottomhole assembly;

capturing, with the camera, a fourth image of the second high-loss circulation zone;

responsive to encountering the second high-loss circulation zone, releasing a third lost circulation media retained within the bottomhole assembly; and receiving a fourth lost circulation media, by the bottomhole assembly, from circulation fluid circulated from a topside facility.

15. The method of claim 14, wherein a particle size of the third lost circulation media is substantially similar to the particle size of the first lost circulation media.

16. The method of claim 14, wherein a particle size of the fourth lost circulation media is substantially similar to the particle size of the second lost circulation media.

17. The method of claim 1, further comprising activating the trigger to release the first lost circulation media retained within the bottomhole assembly.

18. The method of claim 17, further comprising actuating the one or more actuable gates by activating the trigger.

19. The method of claim 18, wherein actuating the one or more actuable gates comprises releasing the first lost circulation media retained within a lost circulation media reservoir in the bottomhole assembly.

20. The method of claim 17, wherein the trigger comprises a ball seat trigger, and releasing the first lost circulation media comprises:

receiving a ball by the ball seat trigger within the bottomhole assembly;

moving the ball seat trigger by a differential pressure across the seated ball; and opening the one or more actuable gates retaining the lost circulation media by the moving ball seat trigger.

* * * * *